US011453042B2

(12) United States Patent
Kamoto et al.

(10) Patent No.: US 11,453,042 B2
(45) Date of Patent: Sep. 27, 2022

(54) FORGING ROLL DEVICE

(71) Applicant: NIPPON STEEL & SUMITOMO METAL CORPORATION, Tokyo (JP)

(72) Inventors: Shinji Kamoto, Niihama (JP); Koichi Kondo, Niihama (JP); Yusaku Kobayashi, Tokyo (JP); Hideki Uchida, Tokyo (JP); Yugo Matsui, Tokyo (JP); Daisuke Hirota, Tokyo (JP); Shunji Matsuzaki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 444 days.

(21) Appl. No.: 16/316,444

(22) PCT Filed: Jul. 13, 2017

(86) PCT No.: PCT/JP2017/025485
§ 371 (c)(1),
(2) Date: Jan. 9, 2019

(87) PCT Pub. No.: WO2018/012569
PCT Pub. Date: Jan. 18, 2018

(65) Prior Publication Data

US 2019/0291170 A1 Sep. 26, 2019

(30) Foreign Application Priority Data

Jul. 15, 2016 (JP) ..... JP2016-140693

(51) Int. Cl.
*B21J 9/02* (2006.01)
*B21H 7/00* (2006.01)
(Continued)

(52) U.S. Cl.
CPC ..... *B21J 9/025* (2013.01); *B21H 7/00* (2013.01); *B21H 9/00* (2013.01); *B21H 9/02* (2013.01); *B21J 9/02* (2013.01); *B21J 13/10* (2013.01)

(58) Field of Classification Search
CPC . B21H 7/00; B21H 7/007; B21H 7/16; B21H 8/02; B21J 9/02; B21J 9/025;
(Continued)

(56) References Cited

U.S. PATENT DOCUMENTS 2,736,948 A 3/1956 Barnes
3,170,343 A * 2/1965 Gauriat ..... B21H 7/16 72/190
(Continued)

FOREIGN PATENT DOCUMENTS

CN 102430678 A 5/2012
DE 19539082 A1 * 4/1997 ..... B21B 27/02
(Continued)

OTHER PUBLICATIONS

Machine Translation of JP 2008238218A, Nishihara Hide (Oct. 9, 2008) (Year: 2008).*
(Continued)

*Primary Examiner* — Debra M Sullivan
(74) *Attorney, Agent, or Firm* — Greer Burns & Crain Ltd.

(57) ABSTRACT

A forging roll device includes, a pair of roll axes which are provided so that an axis center of each of the roll axes are parallel to each other and in which a die is attached to each of the roll axes; and a material holder/conveyer which conveys a held shaping target material between the pair of roll axes, wherein, each one of the pair of roll axes includes a plurality of die attaching surfaces positioned in a circumferential direction, and an outer circumferential surface
(Continued)

between any of two of the plurality of die attaching surfaces in each one of the pair of roll axes is closer to a planar surface than a cylindrical surface with the axis center as the center.

5 Claims, 7 Drawing Sheets

(51) Int. Cl.
*B21H 9/02* (2006.01)
*B21J 13/10* (2006.01)
*B21H 9/00* (2006.01)

(58) Field of Classification Search
CPC ..... B21J 13/02; B21J 13/10; B21B 1/024; B21B 1/026; B21B 1/166
See application file for complete search history.

(56) References Cited

U.S. PATENT DOCUMENTS 3,561,240 A * 2/1971 Schey ..... B22D 11/066 72/184
4,316,377 A * 2/1982 Fencl ..... B21H 7/16 72/189

FOREIGN PATENT DOCUMENTS

| | | | | |
|---|---|---|---|---|
| DE | 102013100302 | A1 * | 7/2014 | ..... B21B 1/024 |
| DE | 102014101150 | A1 | 7/2015 | |
| JP | 4733020 | U | 5/1946 | |
| JP | 60121027 | A | 6/1985 | |
| JP | 5169176 | A | 7/1993 | |
| JP | 2008238218 | A | 10/2008 | |

OTHER PUBLICATIONS

Office action/search report issued in related Chinese Application No. 2017-80043597.X, dated Oct. 19, 2020 (with machine translation).
Int'l. Preliminary Report on Patentability issued in Int'l. Application No. PCT/JP2017/025485, dated Jan. 15, 2019 (with translation).
Japanese office action issued in corresponding Japanese patent application No. 2016-140693, dated Jan. 7, 2020 (with machine translation).
Chinese office action issued in related Chinese patent application No. 201780043597.X, dated Dec. 3, 2019 (with machine translation).
Search report issued in corresponding EP application No. 17827692.9, dated Feb. 28, 2020.
ISR issued in Int'l. Patent App. No. PCT/JP2017/025485, dated Sep. 19, 2017.
Office action issued in corresponding Japanese application No. 2016-140693, dated Sep. 12, 2019 (with translation).
Office action/search report issued in related Indian Application No. 2019-17001851, dated Sep. 16, 2020.

* cited by examiner

FORGING ROLL DEVICE

This is a National Phase Application filed under 35 U.S.C. § 371, of International Application No. PCT/JP2017/025485, filed Jul. 13, 2017, the contents of which are incorporated by reference.

TECHNICAL FIELD

The present invention relates to a forging roll device.

BACKGROUND ART

A forging roll device is a device which applies a load on a material to be shaped to shape the material to be shaped. The forging roll device performs preliminary shaping of the material to be shaped at a point upstream of a forging press in order to enhance yield of forgings, for example.

Typically, the forging roll device includes a pair of roll axes facing each other, a plurality of dies attached to the pair of roll axes and a manipulator which conveys the material to be shaped. When the pair of roll axes rotate, the pair of dies face each other and come near each other. Here, the manipulator conveys the material to be shaped between the pair of roll axes. With this, the material to be shaped is sandwiched between the pair of dies and shaped.

Patent Literature 1 discloses a forging roll device in which a plurality of dies are attached aligned in a circumferential direction of a roll axis. According to such configuration, when a pair of roll axes are rotated, a plurality of types of pairs of dies face each other and come close to each other in order. With this, shaping using a plurality of types of dies can be performed with one forging roll device. For example, as the plurality of types of dies, a shape which starts from a shape of the raw material of the material to be shaped and gradually comes close to a complete shape of a preliminary shaped product can be applied. By performing shaping a plurality of times using a plurality of dies in order, a shaped product with high precision and high quality can be obtained.

Even if a configuration in which a plurality of dies are aligned in an axis direction of the roll axis is employed, shaping using a plurality of types of dies can be performed with one forging roll device. However, according to such configuration, an axial length of the roll axis becomes long, and deflection of the roll axis in the shaping becomes large. According to the forging roll device as described in patent literature 1, it is possible to perform shaping using a plurality of types of dies without making the deflection of the roll axis large.

PRIOR ART DOCUMENT

Patent Literature

Patent Literature 1: Japanese Patent Application Laid-Open Publication No. 2008-238218

DISCLOSURE OF THE INVENTION

Problems to be Solved by the Invention

The forging roll device according to Patent Literature 1 includes a roll axis in a cylindrical column shape. A plurality of dies are attached to a cylinder surface shaped outer circumferential surface of a roll axis. Therefore, between the plurality of dies aligned in the circumferential direction, there is the outer circumferential surface of the roll axis with a cross section in an arc shape. Therefore, a space between the pair of roll axes becomes small, and when the manipulator conveys the material to be shaped between the pair of roll axes, there is a possibility that the manipulator interferes with the roll axes.

The purpose of the present invention is to provide a forging roll device in which the plurality of dies can be positioned aligned in a circumferential direction of a roll axis and in which a material holder/conveyer (for example, a manipulator) hardly interferes with the roll axes.

Means for Solving the Problem

According to an aspect of the present invention, there is a forging roll device including: a pair of roll axes which are provided so that an axis center of each of the roll axes are parallel to each other and in which a die is attached to each of the roll axes; and a material holder/conveyer which conveys a held shaping target material between the pair of roll axes, wherein, each one of the pair of roll axes includes a plurality of die attaching surfaces positioned in a circumferential direction, and an outer circumferential surface between any of two of the plurality of die attaching surfaces in each one of the pair of roll axes is closer to a planar surface than a cylindrical surface with the axis center as the center.

Advantageous Effect of the Invention

According to the present invention, it is possible to provide a forging roll device in which the plurality of dies can be positioned aligned in a circumferential direction of a roll axis and in which a material holder/conveyer unit hardly interferes with the roll axes.

EMBODIMENT FOR CARRYING OUT THE INVENTION

An embodiment of the present invention is described in detail with reference to the drawings.

Figure 1:
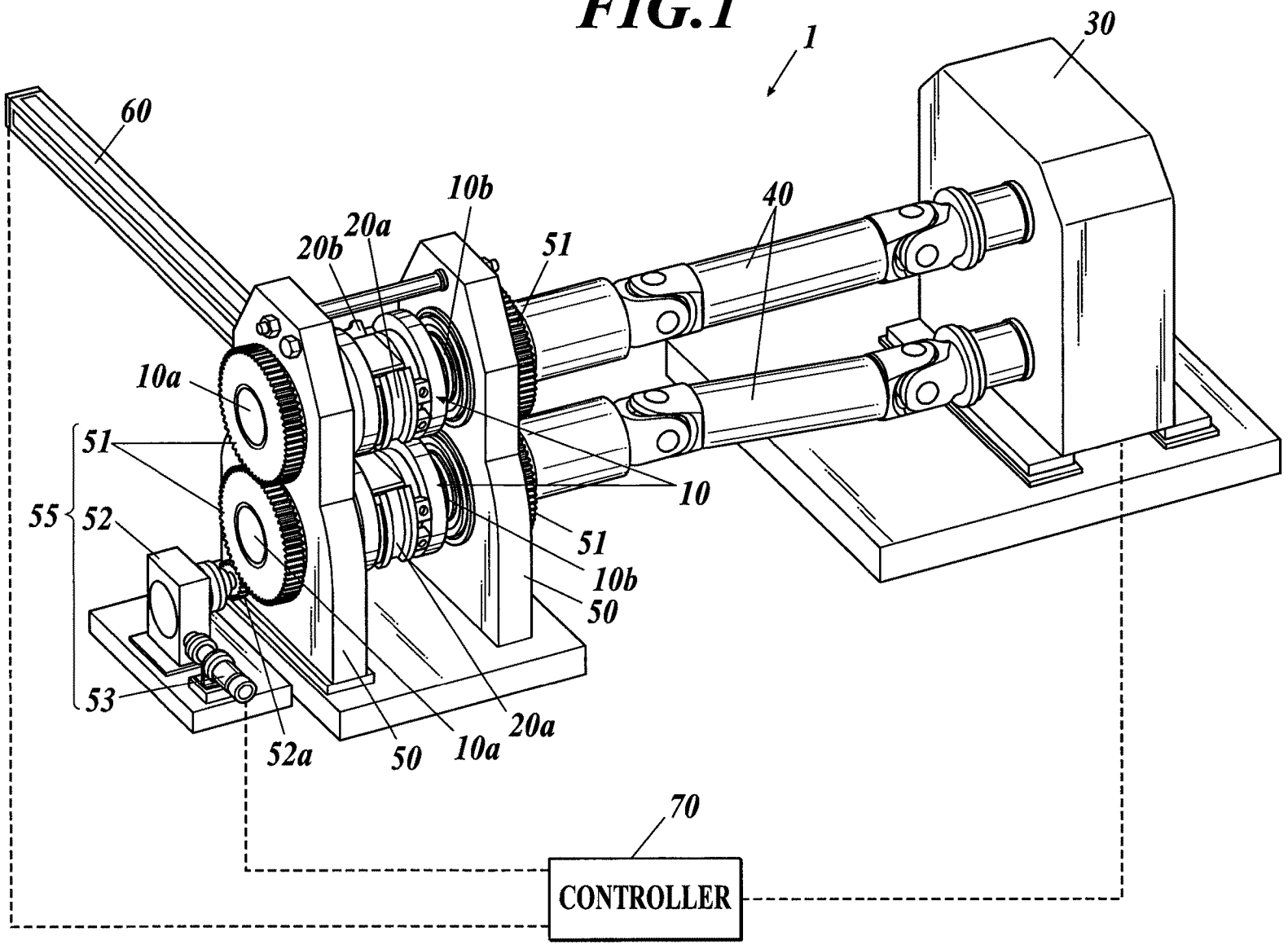
FIG. 1 is a perspective view showing a forging roll device according to an embodiment of the present invention.
Figure 2:
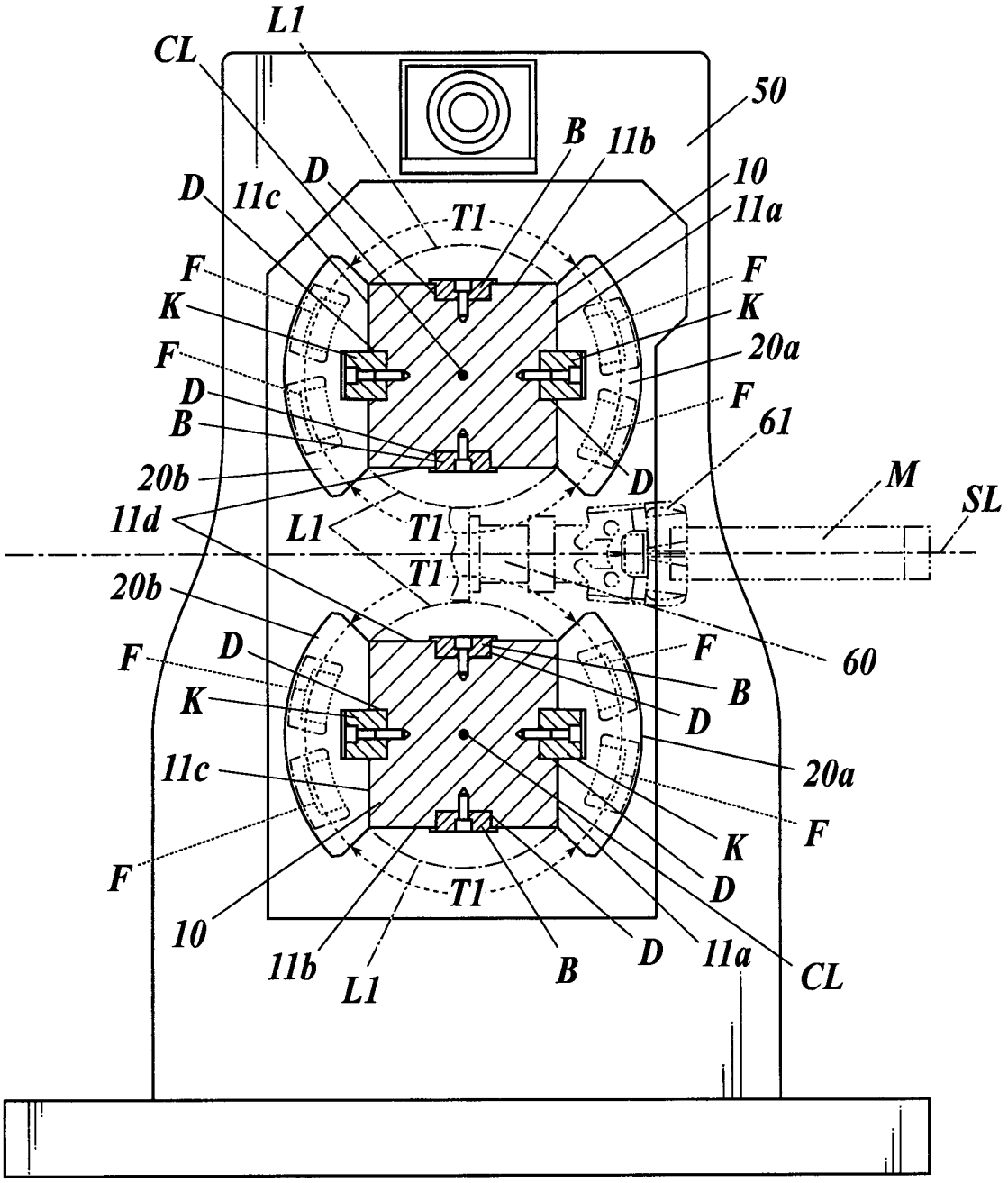
FIG. 2 is a side partial breakaway view showing a portion of a die attaching surface in a roll axis.

FIG. 1 is a perspective view showing a forging roll device according to an embodiment of the present invention. FIG. 2 is a side partial breakaway view showing a portion of a die attaching surface in a roll axis.

The forging roll device 1 according to an embodiment of the present invention is a device which shapes a shaping target material M by applying pressure to a metallic shaping target material M. For example, the forging roll device 1 is used at a point upstream of a forging press to enhance yield of a forged product and performs preliminary shaping of the shaping target material M. The forging roll device 1 includes a pair of roll axes 10, a plurality of dies 20*a*, 20*b*, a driving device 30, a transmitting mechanism 40, a frame 50, an adjusting mechanism 55, a manipulator 60, and a controller 70. The manipulator 60 corresponds to an example of a material holder/conveyer according to the present invention.

The pair of roll axes 10 are aligned so that the axial cores are parallel to each other and are supported by the frame 50 by an adjustment mechanism 55. As shown in FIG. 2, the roll axes 10 include a plurality of die attaching surfaces 11*a* to 11*d* in a circumferential direction. Among the plurality of die attaching surfaces 11*a* to 11*d*, the surfaces on which the dies are attached at the same time in a shaping process are two die attaching surfaces 11*a* and 11*c* (or 11*b* and 11*d*) positioned in a direction opposite to each other. Therefore, when a plurality of dies 20*a* and 20*b* are attached to one roll axis 10, there are die attaching surfaces 11*b* and 11*d* without dies between the two die attaching surfaces 11*a* and 11*c* with the dies 20*a* and 20*b*. Below, a section in which the die is not attached along the circumferential direction of the roll axis 10 is described as "gap section T1".

The die attaching surfaces 11*a* to 11*d* have a shape including a plane. Specifically, at least half of the region of the die attaching surfaces 11*a* to 11*d* is shaped as a plane. More specifically, each plane includes a shape in which a key groove D is formed. The key groove D is provided in the center of the die attaching surfaces 11*a* to 11*d* along the circumferential direction of the roll axis 10. A key K is engaged in the key groove D. The key K is projected in a radius direction of the roll axis 10 from the planar portion of the die attaching surfaces 11*a* and 11*c*. The key K is engaged with the dies 20*a* and 20*b* so that the dies 20*a* and 20*b* do not move in the circumferential direction.

In the gap section T1 without the die, the roll axis 10 includes an outer circumferential surface closer to a plane than a cylindrical surface (shown with a long dash double short dash line L1 in FIG. 2) with the axis CL as the center. Here, as shown with the long dash double short dash line L1 in FIG. 2, the cylindrical surface means a cylindrical surface including the same radius as an edge in the circumferential direction in one of the die attaching surfaces 11*a* and 11*c*. The plane means one plane connecting two adjacent edges aligned in the circumferential direction among four edges of the two die attaching surfaces 11*a* and 11*c*. According to the above configuration, when the gap sections T1 of the pair of roll axes 10 face each other, a comparatively large space is provided between the pair of roll axes.

As described above, according to the present embodiment, the outer circumferential surface of the gap section T1 of the roll axis 10 is the die attaching surface 11*b* and 11*d* with no die attached. Although not limited, a block B is engaged to the key groove D of these die attaching surfaces 11*b* and 11*d*. Unlike the key K, the block B is not projected in the radius direction from the die attaching surfaces 11*b* and 11*d*.

The dies 20*a* and 20*b* are formed in a shape to apply pressure to the shaping target material M in the outer circumferential side. The dies 20*a* and 20*b* include a plane portion corresponding to the die attaching surfaces 11*a* to 11*d* on an inner circumferential side (back surface side) and a key groove in which the key K is fitted in. The key groove is provided in the center of the plane portion in the circumferential direction of the roll axis 10.

The plurality of dies 20*a* and 20*b* include a first pair of dies 20*a* and a second pair of dies 20*b*. Each of the first pair of dies 20*a* and the second pair of dies 20*b* are attached to the roll axes 10. The first pair of dies 20*a* come close and face each other when the pair of roll axes 10 come to a predetermined rotating angle. With this, a first pass of the shaping of the shaping target material M is performed. The second pair of dies 20*b* come close and face each other when the pair of roll axes 10 come to a predetermined rotating angle. With this, a second pass of the shaping of the shaping target material M is performed. The "first pass" and the "second pass" mean the number of times that the shaping target material M passes between the pair of dies and is shaped.

Figure 3:
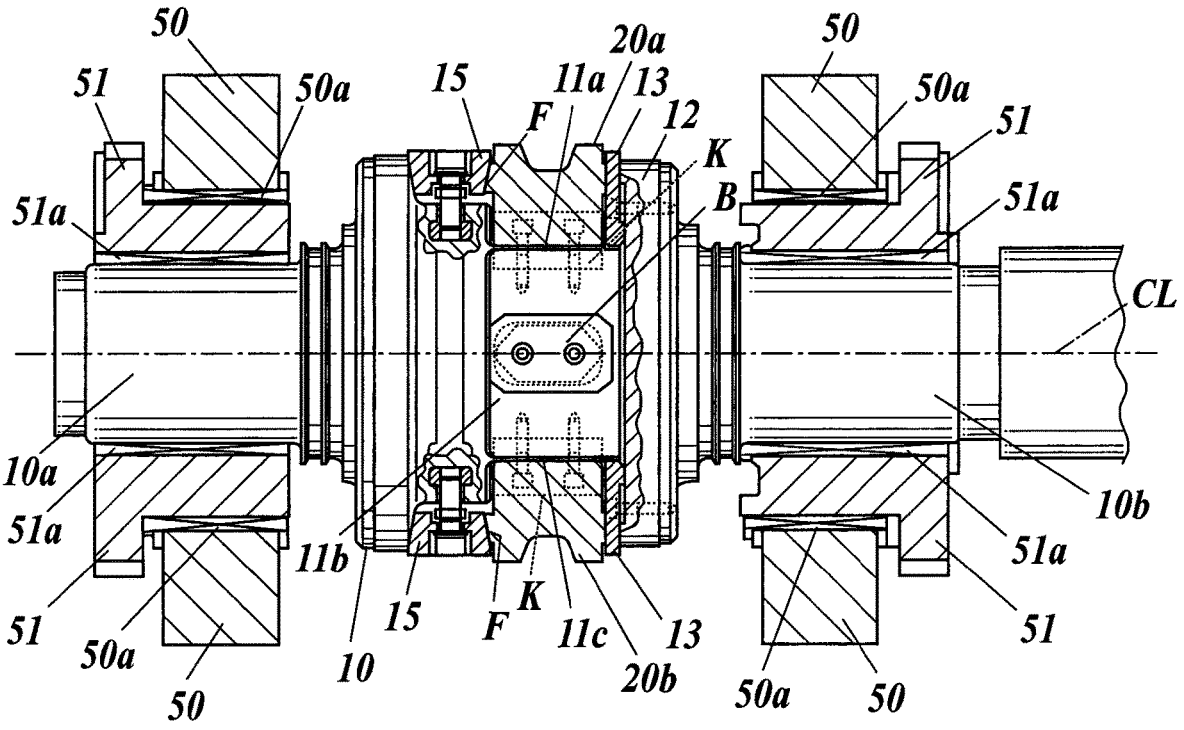
FIG. 3 is a planar partial breakaway view showing an attaching structure of a die and a supporting structure of the roll axis.

FIG. 3 is a planar partial breakaway view showing an attaching structure of a die and a supporting structure of the roll axis.

The dies 20*a* and 20*b* are fixed to the roll axis 10 by the fitting of the key K and being nipped from the axis direction of the roll axis 10. In detail, as shown in FIG. 3, one side of the dies 20*a* and 20*b* is in contact with a flange 12 of the roll axis 10 with a patch 13 in between. A projection F formed inclined in a direction so that the amount of projection increases closer to an axis center CL is provided on the other side of the dies 20*a* and 20*b*. A wedge 15 in contact with the projection F of the dies 20*a* and 20*b* is engaged to the roll axis 10. According to the above configuration, the wedge 15 pressures the projection F so that the force is applied to the dies 20*a* and 20*b* toward the axis direction and the radius direction of the roll axis 10, and the dies 20*a* and 20*b* are fixed to the roll axis 10 at a high strength.

The driving device 30 (see FIG. 1) includes a pair of servo motors (not shown) and a pair of speed reducers (not shown). The pair of servo motors is linked to the pair of roll axes 10 through the pair of speed reducers and the transmitting mechanism 40. The servo motors drive the pair of roll axes 10 while detecting the rotating angle.

The transmitting mechanism 40 transmits a rotating motion of the servo motors through the speed reducers to the roll axis 10. The transmitting mechanism 40 includes a universal joint and follows the change in between the roll axes 10.

The frame 50 supports through the adjustment mechanism 55 the roll axis 10 so as to be able to rotate.

Figure 4:
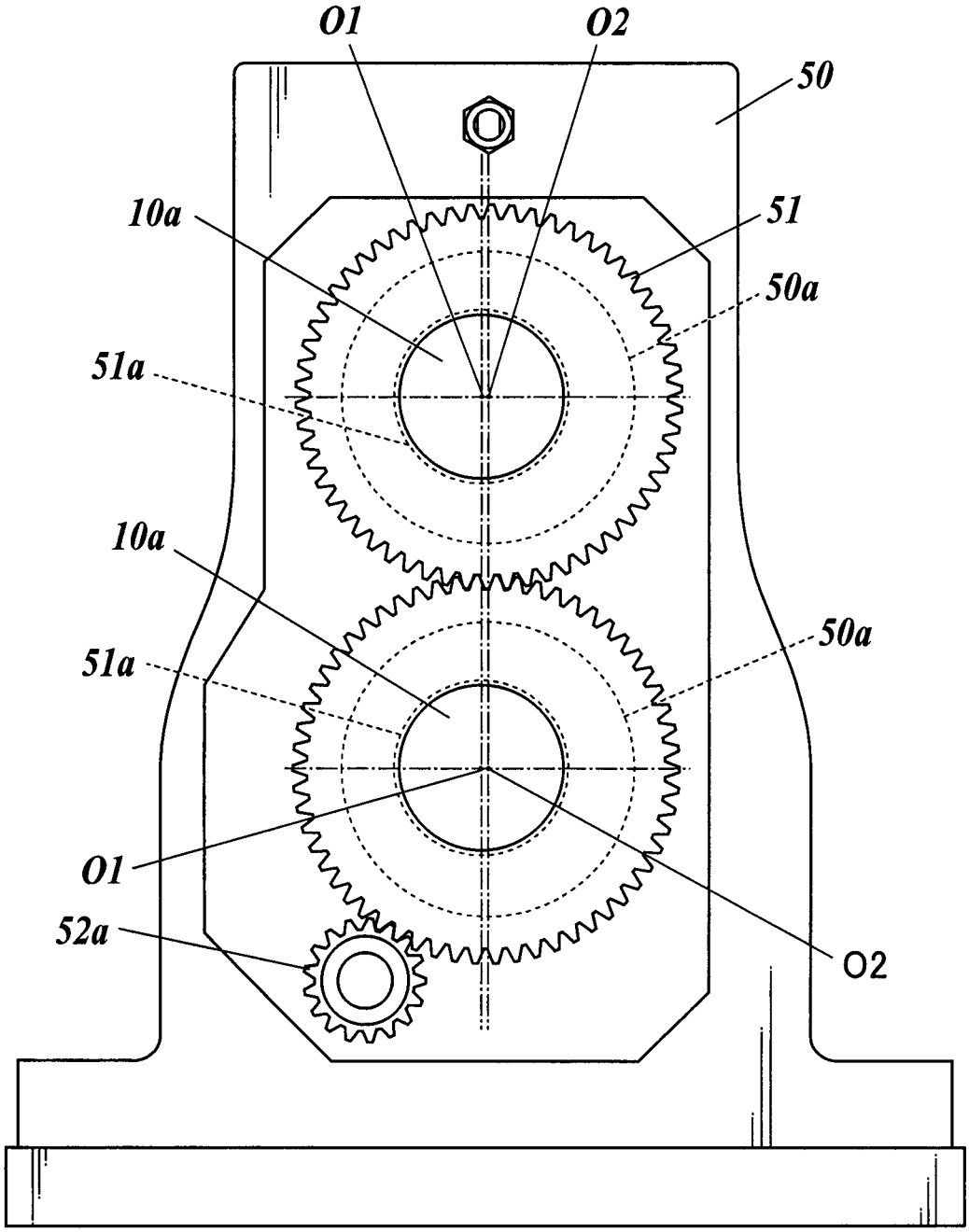
FIG. 4 is a side view showing an adjustment mechanism which changes a distance between axes in a pair of roll axes.

FIG. 4 is a side view showing an adjustment mechanism which changes a distance between the pair of roll axes.

The adjustment mechanism 55 is a mechanism which changes the distance between the pair of roll axes 10. The adjustment mechanism 55 includes four eccentric gears 51, and a speed reducer 52 and a motor 53 which drive the four eccentric gears 51 (see FIG. 1). On the inner circumferential side of the eccentric gears 51, a bearing 51*a* is provided to support one end 10*a* or the other end 10*b* of the roll axis 10 so as to be able to rotate (see FIG. 3). A rotating center O1 of the eccentric gear 51 and a center O2 of the bearing 51*a* are eccentric (see FIG. 4).

The four eccentric gears 51 are each supported to be able to rotate by four bearings 51*a* of the frame 50. The two eccentric gears 51 positioned in one axis direction are engaged with each other and rotate in an opposite direction. The same can be said for the two eccentric gears 51 positioned in the other axis direction. The speed reducer 52 is linked to the eccentric gears 51 in one axis direction and the other axis direction through the gear 52*a*.

According to such configuration, when the motor 53 is driven, the four eccentric gears 51 rotate in the same rotating angle. The upper eccentric gear 51 and the lower eccentric gear 51 rotate in a direction opposite to each other. When the four eccentric gears 51 rotate, the bearing 51*a* of the upper eccentric gear 51 and the bearing 51*a* of the lower eccentric gear 51 change in the opposite direction in the same amount in a vertical direction. With this, the distance between the pair of roll axes 10 changes. Further, even if the distance between the axes changes, the center straight line passing between the pair of roll axes 10 (the straight line which passes the center point in the middle of the pair of roll axes 10 and which extends in the circumferential direction of the roll axes 10) is not displaced. Therefore, when the manipulator 60 moves back and forth on the center straight line between the pair of roll axes 10, even if the space between the pair of roll axes 10 changes, the distance between the manipulator and the pair of roll axes 10 is not biased to one side.

The manipulator 60 includes a gripper 61 which grips the shaping target material M (see FIG. 2) and an advance/retreat mechanism (not shown) which moves the gripper 61 forward and backward. The gripper 61 is positioned at the tip of the manipulator 60. The advance/retreat mechanism moves the gripper 61 on a straight line along a center straight line SL between the pair of roll axes 10. The advance/retreat mechanism can twist the gripper 61 at least 90° in a rotating direction with the straight line as the center.

The controller 70 controls the operation of the servo motor (not shown) of the driving device 30 and the manipulator 60. The controller 70 can control the motor 53 of the adjustment mechanism 55.

<Shaping Process>

Next, the shaping process by the forging roll device 1 according to the present embodiment is described.

FIG. 5A to FIG. 7D are descriptive diagrams showing a shaping process of a forging roll device according to the present embodiment. FIG. 5A to FIG. 5D show the first step to fourth step. FIG. 6A to FIG. 6D show the fifth step to eight step. FIG. 7A to FIG. 7D show the ninth step to twelfth step.

Figure 5A:
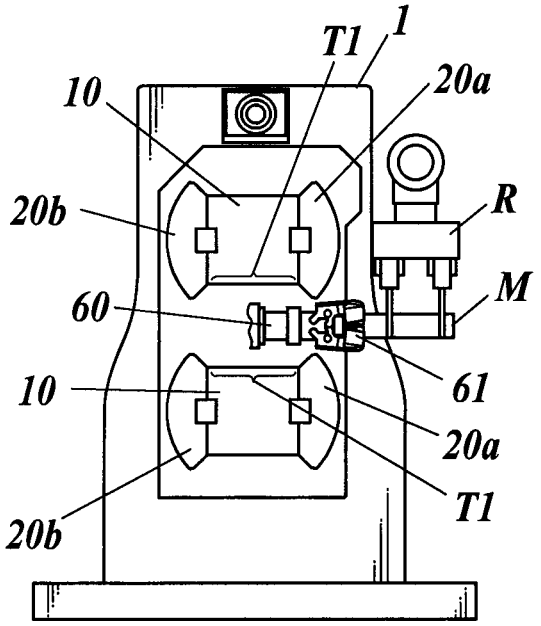
FIG. 5A to FIG. 5D are diagrams showing a first step to a fourth step of a shaping process in a forging roll device according to the present embodiment.

As shown in FIG. 5A, when the shaping process starts, the pair of roll axes 10 stop at a rotating angle where the gap sections T1 face each other. The manipulator 60 passes between the gap section T1 and positions the gripper 61 in a standby position. The standby position is sufficiently separated from the pair of roll axes 10, and the robot R is able to convey the shaping target material M to the gripper 61 without interfering with the dies 20*a* and 20*b*. At the start of the shaping process, the gripper 61 receives the shaping target material M from the robot R.

Figure 5B:
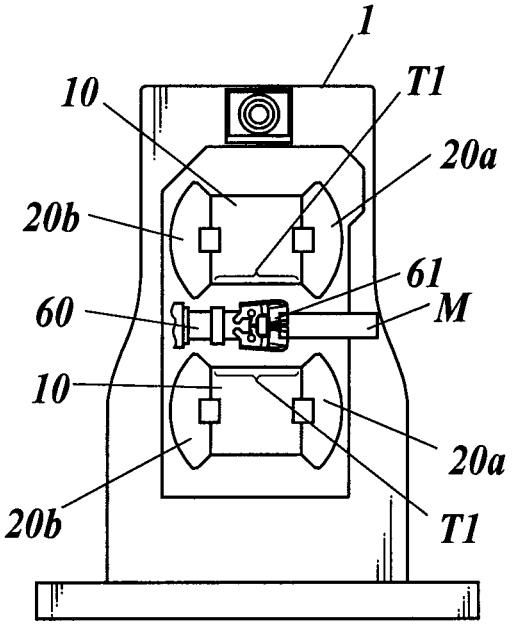
Figure 5C:
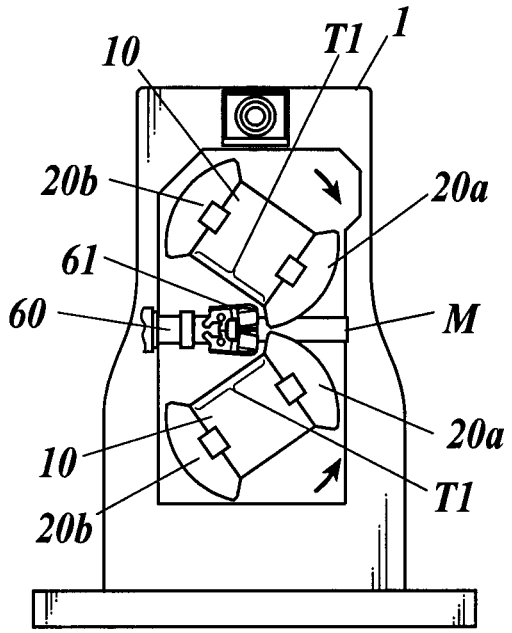
Figure 5D:
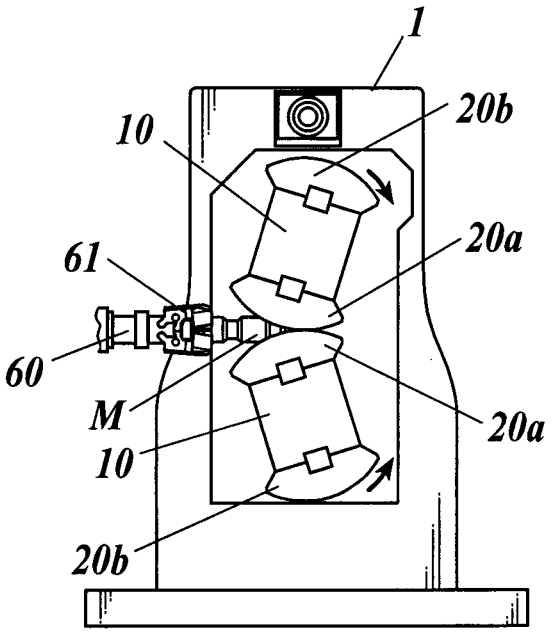
Figure 6A:
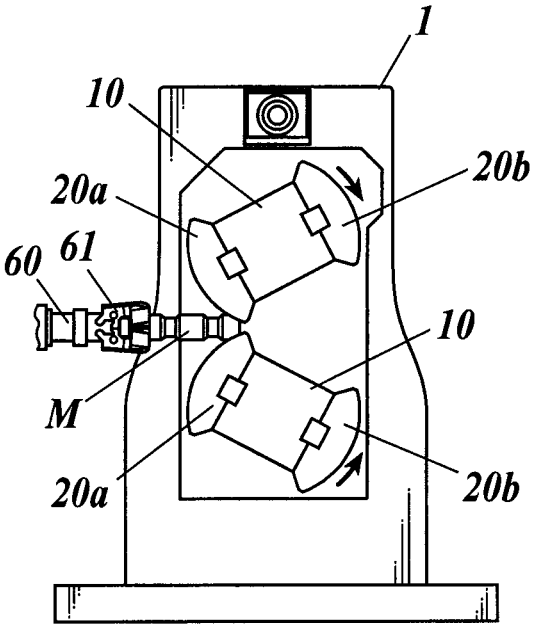
FIG. 6A to FIG. 6D are diagrams showing a fifth step to an eight step of the shaping process in the forging roll device according to the present embodiment.

When the gripper 61 grips the shaping target material M, as shown in FIG. 5B, the manipulator 60 retreats, and the gripper 61 moves to a position between the pair of roll axes 10. Then, as shown in FIG. 5C, FIG. 5D, and FIG. 6A, the pair of roll axes 10 rotate by being driven by the driving device 30, and the first pair of dies 20*a* become close and face each other continuously from one end to the other end. In coordination with the above, the manipulator 60 synchronizes with the rotation of the roll axis 10 and retreats.

According to the above movements, the first pass of the shaping is performed on the shaping target material M. In detail, first, one end of the shaping target material M gripped by the gripper 61 is engaged in one end of the pair of dies 20*a* (FIG. 5C). Next, the portions of the pair of dies 20*a* facing each other continuously move from one end to the other end of the die 20*a*, and at the same time, the shaping target material M moves and the portion engaged in the pair of dies 20*a* continuously moves from one end to the other end (FIG. 5D). Then, the shaping target material M is released from the pair of dies 20*a*, and retreats to a position that does not interfere with the die 20*a* (FIG. 6A). During this time, the shaping target material M is pressed by the pair of dies 20*a* and is shaped.

Figure 6B:
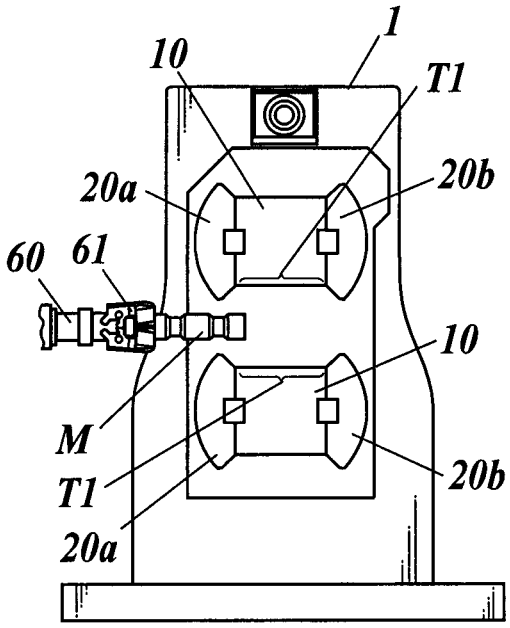
Figure 6C:
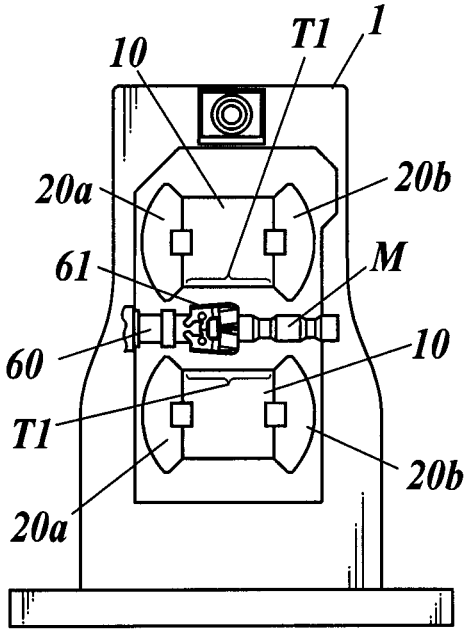

When the shaping of the first pass is finished, the roll axis 10 rotates in the same direction, and the roll axis 10 stops at a rotating angle in which the gap sections T1 without the die face each other (FIG. 6B). Then, the manipulator 60 moves forward and the shaping target material M moves to the position where the second pass of the shaping starts (FIG. 6C). Here, the manipulator 60 can rotate the shaping target material M in a twisting direction in relation to the advancing direction. With such rotation, the direction that the pressure is applied to the shaping target can be differed by 90 degrees between the first pass of the shaping and the second pass of the shaping.

Figure 6D:
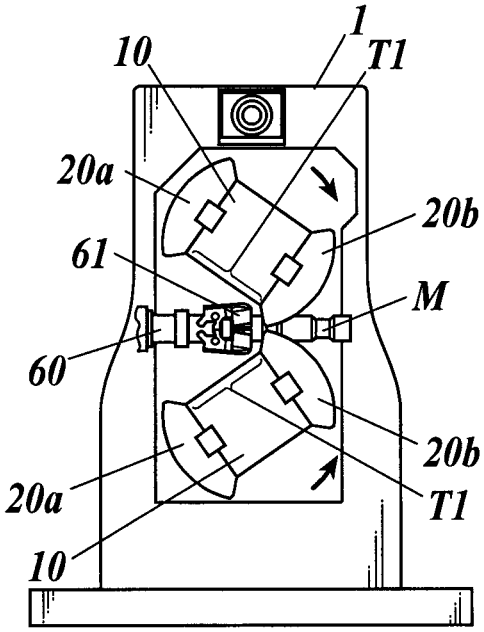
Figure 7A:
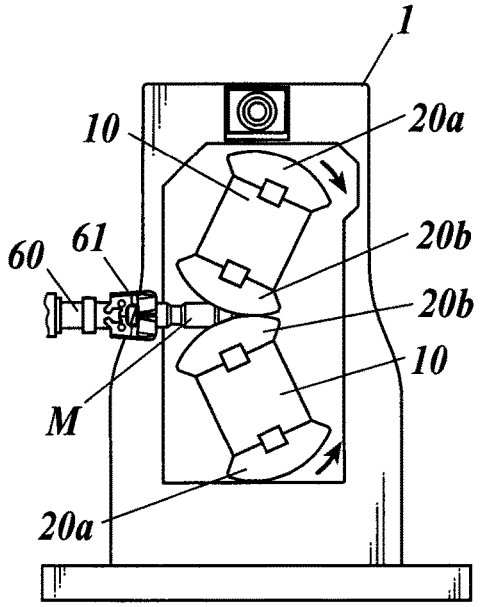
FIG. 7A to FIG. 7D are diagrams showing a ninth step to a twelfth step of the shaping process in the forging roll device according to the present embodiment.
Figure 7B:
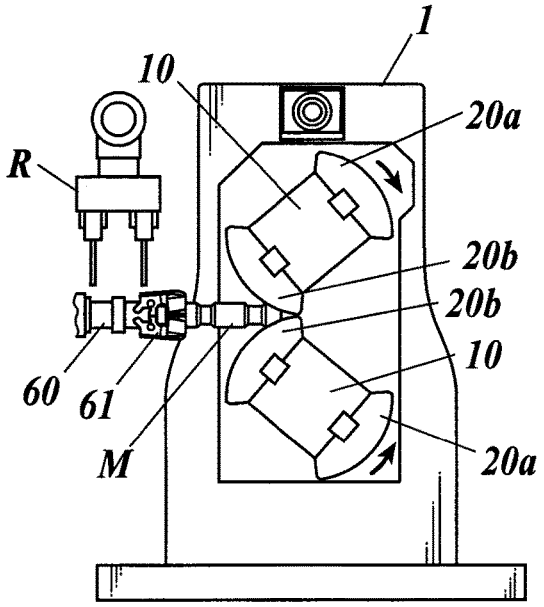

Next, as shown in FIG. 6D, FIG. 7A, and FIG. 7B, the pair of roll axes 10 rotate by being driven by the driving device 30, and the second pair of dies 20*b* come close and face each other continuously from one end to the other end. In coordination with the above, the manipulator 60 synchronizes with the rotation of the roll axes 10 and retreats. According to the above motions, the second pass of the shaping is performed on the shaping target material M. In detail, first, one end of the shaping target material M gripped by the gripper 61 is engaged in one end of the pair of dies 20*b* (FIG. 6D). Then, the portions of the pair of dies 20*b* facing each other moves from one end to the other end of the die 20*b*, and at the same time, the shaping target material M moves and the portion engaged in the pair of dies 20*b* moves from one edge to the other edge (FIG. 7A). Then, the shaping target material M is released from the pair of dies 20*b* and retreats to a position that does not interfere with the die 20*b* (FIG. 7B).

Figure 7C:
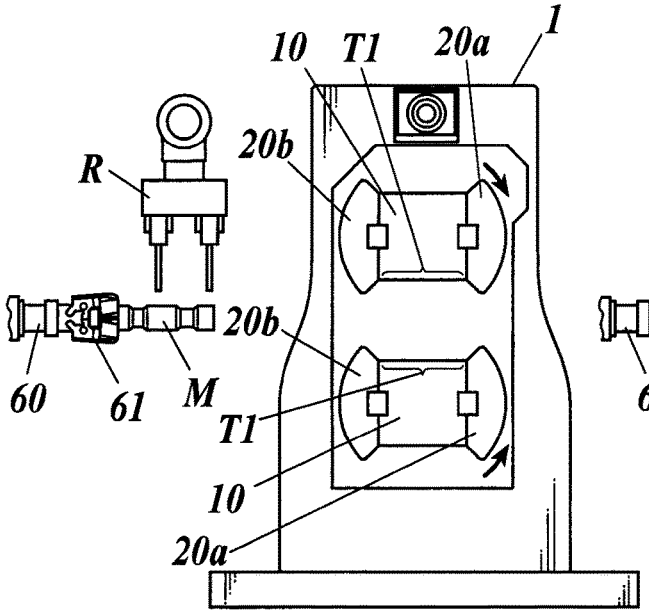
Figure 7D:
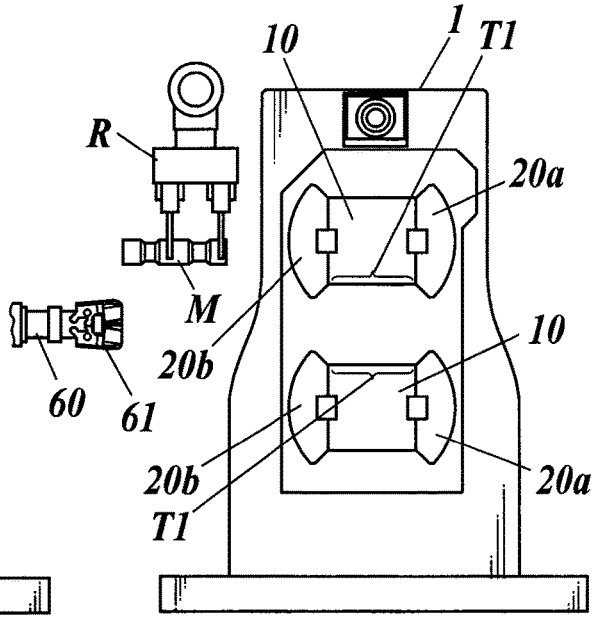

Next, the roll axis 10 rotates in the same direction and stops at a rotating angle in which the gap sections T1 without the die face each other (FIG. 7C). Moreover, the manipulator 60 retreats to the portion where the shaping target material M is delivered. Further, the robot R receives the shaping target material M from the manipulator 60 and the shaping process of one shaping target material M ends (FIG. 7D).

The above-described operation of the roll axes 10 in coordination with the manipulator 60 during the shaping process is executed by the controller 70 controlling the servo motor of the driving device 30 and the manipulator 60.

<Adjustment Between Axes>

Next, the function to adjust the distance between the pair of roll axes 10 is described.

The adjustment of the distance between axes is performed for the purpose of enhancing dimensional accuracy when a predetermined dimensional accuracy cannot be obtained in shaping the shaping target material M. For example, the user uses the forging roll device 1 to perform a trial of the shaping process on the shaping target material M. Then, after the trial shaping process is performed, the user measures the dimension of the shaping target material M to confirm whether the desired dimensional accuracy is obtained. For example, the user measures the dimensions of the necessary portions such as the portion in which the thickness of the shaping target material M becomes very large or a portion which is to be a joint. The measured dimension is compared with a goal dimension.

Here, when the dimension of the shaping target material M is larger than the goal dimension, the user drives the adjustment mechanism 55 to make the space between the pair of roll axes 10 smaller. With this, the distance that the pair of dies 20*a* or dies 20*b* come close and face each other becomes smaller. Therefore, the pressure applied to the shaping target material M by the dies 20*a* or dies 20*b* becomes larger. Then, the dimension after shaping the shaping target material M can be made closer to the goal dimension.

When the dimension of the shaping target material M is smaller than the goal dimension, the user drives the adjustment mechanism 55 to make the space between the pair of roll axes 10 larger. With this, the distance that the pair of dies 20*a* or dies 20*b* come close and face each other becomes larger. Therefore, the pressure applied to the shaping target material M by the dies 20*a* or 20*b* becomes smaller. With this, the dimension after shaping the shaping target material M can be made closer to the goal dimension.

The adjustment between the roll axes 10 can be performed after the shaping with the first pair of dies 20*a* in the trial pressing process or after the shaping with the second pair of dies 20*b*. The length between the axes suitable for shaping with the first pair of dies 20*a* may be different from the length between the axes suitable for shaping with the second pair of dies 20*b*. In this case, in the middle of one shaping process, a process to change the space between the pair of roll axes 10 can be added. Specifically, the controller 70 changes the space between the axes corresponding to the first pair of dies 20*a* during standby for the first pass as shown in FIG. 5B, and changes the space between the axes corresponding to the second pair of dies 20*b* during standby for the second pass as shown in FIG. 6C. Further, preferably, in this case, the controller 70 stores in advance the driving amount of the motor in the adjustment mechanism 55, and automatically operates the adjustment mechanism 55 in the middle of one shaping process.

As described above, according to the forging roll device 1 of the present embodiment, in each roll axis 10, there is the gap section T1 without the die between the die attaching surfaces 11*a* and 11*c* on which the two dies 20*a* are attached. The outer circumferential surface of the gap section T1 of each roll axis 10 is closer to a planar surface than a cylindrical surface (see long dash double short dash line L1 in FIG. 2) with the axis center CL of the roll axis 10 as the center. Therefore, when the outer circumferential surfaces of the gap sections T1 in the pair of roll axes 10 face each other, a relatively large space is provided between the above. Therefore, when the manipulator 60 moves between the pair of roll axes 10, interference hardly occurs between the roll axis 10 and the manipulator 60.

According to the forging roll device 1 of the present embodiment, the die attaching surfaces 11*a* to 11*d* of the roll axes 10 have a shape including a planar surface. Specifically, at least half of the region of the die attaching surfaces 11*a* to 11*d* have a planar surface shape. More specifically, the die attaching surfaces 11*a* to 11*d* have a shape with a key groove D provided in one planar surface. According to the above configuration, the back surface of the dies 20*a*, 20*b* can be made in a planar surface shape. The dies 20*a* and 20*b* are made by performing processing such as cutting from one piece of metal. Therefore, by forming one surface of the dies 20*a* and 20*b* in a planar surface shape, the processing accuracy is enhanced, and the manufacturing cost can be drastically decreased. Further, since the back side of the die attaching surfaces 11*a* to 11*d* and the dies 20*a* and 20*b* have a planar surface shape, the key K can be provided in the center of the die attaching surfaces 11*a* to 11*d* in the circumferential direction of the roll axis 10. That is, the key K can be provided on the back surface side of the dies 20*a* and 20*b*. Therefore, the key K is not provided in the gap section T1 of the roll axis 10 as in the conventional configurations. Therefore, when the manipulator 60 moves between the pair of roll axes 10, the manipulator 60 does not interfere with the key K.

Further, according to the forging roll device 1 of the present embodiment, other die attaching surfaces 11*b* and 11*d* are provided on the gap section T1 of each roll axis 10. The die attaching surfaces 11*a* and 11*c* on which the dies 20*a* and 20*b* are attached deteriorate as the number of times the shaping process is performed increases because high pressure is applied from the dies 20*a* and 20*b*. Therefore, it is possible to employ a method in which the die attaching surfaces 11*a* to 11*d* are divided into two groups, and when the die attaching surfaces 11*a* and 11*c* in one group deteriorates, the die attaching surfaces 11*b* and 11*d* in the other group are used. Alternatively, it is possible to employ a method in which the first group of die attaching surfaces 11*a* and 11*c* are used alternately with the second group of die attaching surfaces 11*b* and 11*d*. With this, the life of the pair of roll axes 10 can be extended drastically.

According to the forging roll device 1 of the present embodiment, the adjustment mechanism 55 moves both of the pair of the roll axes 10 in the same amount and changes the position of the space between the axes. Therefore, when the space between the axes is adjusted, there is no bias in the distance between the manipulator 60 and one roll axis 10 and the distance between the manipulator 60 and the other roll axis 10. Therefore, even if the space between the axes is adjusted, it is possible to prevent the manipulator 60 from interfering with the roll axis 10 without changing the path that the manipulator 60 advances and retreats.

In order to provide an adjustment mechanism 55 which displaces both of the pair of roll axes 10, it is necessary to provide a space in which the two eccentric gears 51 can be provided aligned in a direction that the pair of roll axes are aligned. The eccentric gear 51 includes the bearing 51*a* on the internal circumferential side, and the eccentric gear 51 is large in the radius direction because of the necessity to be able to endure high pressure. Therefore, a large space is necessary to align the two eccentric gears 51. According to the present embodiment, the dies 20*a* and 20*b* in which the back surface is a planar surface corresponding to the die attaching surfaces 11*a* to 11*d* of the roll axes 10 can be employed. The dies 20*a* and 20*b* in which the back surface is a planar surface shape can make the thickness of the roll axis 10 in the radius direction thick easily. As a result, the distance between the axes can be made longer easily without making the radius of the pair of roll axes 10 larger. Therefore, according to the present embodiment, the distance between the axes of the pair of roll axes 10 is made larger so that the space to align two eccentric gears 51 which are large in the radius direction can be easily made. With this, the above-described adjustment mechanism 55 can be easily provided.

According to the forging roll device 1 of the present embodiment, the pair of roll axes 10 and the manipulator 60 are controlled to be synchronized as shown in FIG. 5 to FIG. 7. With this, while the pair of roll axes 10 make one rotation, the first pass of the shaping and the second pass of the shaping on one shaping target material M can be performed successively.

The present embodiment is described above. However, the present invention is not limited to the above embodiments. For example, in the above-described embodiment, the outer circumferential surfaces of the gap sections T1 without the die in the roll axes 10 are to be different die attaching surfaces 11*b* and 11*d*. However, the outer circumferential surface of the gap section T1 does not have to be the die attaching surface. According to the present embodiment, the outer circumferential surface of the gap section T1 of the roll axis 10 is a planar surface shape. The shape does not need to be a planar surface shape and may be a shape closer to a plane than a cylindrical surface with the axis center CL as the center. For example, the outer circumferential surface of the gap section T1 can be a curved surface shape with a concave more than a plane or a convex shape close to a plane. The outer circumferential surface of the gap section T1 may be a shape including bumps.

According to the present embodiment, the die attaching surfaces 11*a* to 11*d* are a shape including a key groove on the planar surface. However, for example, the die attaching surface can be a shape including a plurality of planes so that the cross-section is a polygonal shape. Alternatively, the shape can include curved surfaces in a portion of the surface, for example, a planar surface with the surrounding edges and corners being a round shape. It is effective when at least half of the die attaching surface is a planar surface.

According to the present embodiment, the die attaching surfaces 11*a* with the dies attached are aligned, the die attaching surfaces 11*c* with the dies attached are aligned and the gap sections T1 are aligned at each range with the rotating angle at 90° in the circumferential direction of the roll axes 10. However, for example, the following configuration is also possible, the die attaching surfaces are aligned, the gap sections T1 are aligned, and the die attaching surfaces are aligned at each range with the rotating angle at 120° in the circumferential direction of the roll axes 10. Alternatively, the die attaching surfaces and the gap sections can be aligned alternately at each range with the rotating angle at 60° in the circumferential direction of the roll axis. The range in degrees held by each die attaching surface and the range in degrees held by each gap section T1 do not have to be equal.

According to the present embodiment, the shaping target material M is shaped when the manipulator 60 retreats. Alternatively, the shaping target material M can be shaped when the manipulator 60 advances. In the above-described embodiment, the direction and the operation direction of each unit is described according to the configuration with the pair of roll axes 10 positioned vertically. However, the pair of roll axes 10 can be aligned in a different direction such as a horizontal direction. In this case, the direction and the operation direction of each unit in the description can be interpreted to be a different direction corresponding to the direction that the pair of roll axes 10 are aligned.

The adjustment mechanism 55 shown in the above-described embodiment can be omitted or a configuration in which the transmitting mechanism 40 is omitted and the driving device 30 is directly connected to the roll axes 10 can be employed.

According to the present embodiment, the forging roll device is used in the preliminary shaping of the product to be shaped, but alternatively, the forging roll device can be used in shaping other than the preliminary shaping (for example, actual shaping). The details of the description of the embodiments can be suitably changed without leaving the scope of the present invention.

INDUSTRIAL APPLICABILITY

The present invention can be used in forging roll devices.

DESCRIPTION OF REFERENCE NUMERALS

1 forging roll device
10 roll axis
11*a* to 11*d* die attaching surface
20*a* first pair of dies
20*b* second pair of dies
55 adjustment mechanism
60 manipulator (material holder/conveyer)
70 controller
CL axis center

What is claimed is:

1. A forging roll device comprising:

a first roll axis and a second roll axis with first and second axial centers respectively, the first and second axial centers being in line with each other, wherein the first roll axis and the second roll axis each include four die attaching surfaces being arranged around the axial centers of the first roll axis and the second roll axis such that the first and second roll axes are arranged in a square configuration;

at least first and second removable dies attached to selected die attaching surfaces of the first roll axis, and at least third and fourth removable dies attached to selected die attaching surface of the second roll axis;

the first roll axis having at least first and second first roll axis gap sections between the first and second removable dies, the first and second first roll axis gap sections not having removable dies and being arranged so that the first and second removable dies and the first and second first roll axis gap sections alternate with each other around the first central axial center, the second roll axis having at least third and fourth second roll axis gap sections between the third and fourth removable dies, the third and fourth second roll axis gap sections not having removable dies and being arranged so that the third and fourth removable dies and the third and fourth second roll axis gap sections alternate with each other around the second central axial center, and a material holder/conveyor which conveys a held shaping target material between the first and second roll axes.

2. The forging roll device according to claim 1, wherein the plurality of die attaching surfaces include a planar surface.

3. The forging roll device according to claim 1, further comprising an adjustment mechanism which is able to change positions at least one of the first and second roll axes to change a distance between the first and second roll axes.

4. The forging roll device according to claim 1, further comprising:

a servo motor which rotates the first and second roll axes; and a controller which controls operations of the material holder/conveyer and the servo motor, wherein the controller controls the servo motor to rotate the first and second roll axes so that the first and third removable dies face each other, and the second and fourth removable dies face each other, and in coordination with a rotation of the first and second roll axes, the controller controls the material holder/conveyer to advance to or retreat from a space between the first roll axis gap sections or the second roll axis gap sections and controls the material holder/conveyer to convey the shaping target material between the first and third removable dies and then to convey the shaping target material between the second and fourth removable dies.

5. The forge rolling device according to claim 1, further comprising:

a key groove in each of the plurality of die attaching surfaces for selectively securing and removing one of the removable dies to one of the selected die attaching surface.

* * * * *